United States Patent [19]

Moore et al.

[11] 4,144,610

[45] Mar. 20, 1979

[54] FLEXIBLE BRISTLE

[75] Inventors: Boyd B. Moore; Clarence E. Kendall, Jr., both of Houston, Tex.

[73] Assignee: Custom Cable Company, Houston, Tex.

[21] Appl. No.: 791,367

[22] Filed: Apr. 27, 1977

[51] Int. Cl.[2] ..... A46D 1/04

[52] U.S. Cl. ..... 15/159 A; 15/55; 15/183; 57/221; 428/383

[58] Field of Search ..... 15/DIG. 3, 179, 159 A, 15/198, 200, 55, 183; 57/149, 146, 153, 162, 164; 156/178, 179; 428/375, 378, 379, 383

[56] References Cited

U.S. PATENT DOCUMENTS

| | | | |
|---|---|---|---|
| 2,561,487 | 7/1951 | Bailhe | 57/146 X |
| 2,727,263 | 12/1955 | Dangremond et al. | 15/55 |
| 3,646,748 | 3/1972 | Lang | 57/153 X |
| 3,649,984 | 3/1972 | Kershaw et al. | 15/55 |
| 3,705,489 | 12/1972 | Smollinger | 57/149 |
| 3,800,522 | 4/1974 | Hughes | 57/149 |

*Primary Examiner*—Edward L. Roberts
*Attorney, Agent, or Firm*—Fulbright & Jaworski

[57] ABSTRACT

A bristle for mounting on a rotatable drum or shaft to form a sweeping device for use in maintaining railroad rails, ties, ballast and way. The bristle contains a length of wire rope with a lubricant within the interstices of the wire and strands of the rope. A low density polyethylene jacket is high compression extruded onto the exterior and into the intersticial area of the length of wire rope thereby containing and permanently sealing the lubricant within the wire rope, increasing the longitudinal stiffness of the rope, and effecting a mechanical interlock between the wire rope and the polyethylene jacket which both secures the strands of the rope together and secures the polyethylene jacket to the rope. A polyurethane jacket is extruded onto the exterior of the polyethylene jacket thereby stiffening the wire rope and polyethylene jacket, protecting the same from abrasion and cutting, and preventing splaying, unraveling or flaring of the bristle.

13 Claims, 4 Drawing Figures

FLEXIBLE BRISTLE

BACKGROUND OF INVENTION

Railroad maintenance of rails, ties and ballast has a need for various kinds of sweepers such as track cleaners, ballast regulators and cribbers. For purposes of description, specification and claims, the term sweepers will include track cleaners, ballast regulators and cribbers. In each of these devices bristles are fastened to a revolving drum or shaft which produces a brushing action. In an attempt to effectuate this rotary brushing action, past devices have employed bristles made of wire rope having strands welded together at the clamp end of the bristle with the wire rope inserted into an equal length tubing. This past construction has proved less than satisfactory because the welded end of the wire rope prevents the strands of the rope from flexing and slipping relative to themselves, thereby causing fatigue and fracture near the affixed end. The tubing sheath has not provided sufficient stiffness of the wire rope nor has it adequately resisted abrasion or tearing.

In the past several additional shortcomings have been encountered. Rotation of the drum or shaft has ejected the tubing sheath from the rope after short service thereby reducing the stiffness of the overall bristle. Abrasion and tearing of the tubing sheath has also exposed the wire rope, causing it to splay, flare or unravel. Splaying, flaring or unraveling of the wire rope in turn has allowed dust particles, grit and other similar foreign matter to enter into the interstices of the wire rope and migrate helically along its length. The failure of the tubing sheath to remain in intimate contact with the wire rope has also allowed entry and migration of dust, grit and other foreign matter. These foreign particles have broken down the lubricating effect of the lubricant located within the wire rope thereby causing accelerated galling of the wire and strands of rope as well as an acceleration of frictional heat resulting from interaction among the wires and strands. Entrance and migration of dust particles, grit and the like, have also been caused by failure of the tubing sheath to be in intimate contact with the wire rope. These particles have created excessive friction thereby restricting the motion of the strands during flexing, and causing them to break from fatigue.

The degeneration of the tubing sheathed wire rope bristle has been self-accelerating. While it is still necessary for the bristle to be located in such a manner that it flexes while being rotated across the surface to be cleaned, in the past the rubber hose sheathing has worn away quite rapidly. Consequently, the resulting decrease in stiffness of the bristle has been compensated for by lowering the drum or shaft so as to force more of the length of the bristle against the surface to be cleaned. The result has been increased flexion during sweeping which has increased the rate of fracture and galling of the wire rope; increased the rapidity of splaying, flaring and unraveling of the rope; facilitated entrance of foreign matter into the interstices of the wires of the rope as well as the interstices between the strands of rope and the rubber sheath; and at the same time reduced sweeping effectiveness.

SUMMARY OF THE INVENTION

The present invention relates to a durable wire bristle which may be affixed to a drum or shaft which when rotated produces a sweeping action. More particularly, the present invention relates to an improved flexible bristle for use in sweepers for maintenance of railroad ties, tracks and ballast.

It is an object of the present invention to utilize in the flexible bristle an economical wire rope such as but not limited to $\frac{3}{4}$ inch through $\frac{7}{8}$ inch 6 × 25 filler wire-preformed, right hand or left hand regular lay, improved plow steel, independent wire rope core.

Another object of the present invention is to provide a suitable lubricant among the wires, core and strands of the wire rope in order to reduce galling and friction thereamong.

Still another object of this invention is to provide a low melt temperature plastic jacket such as a polyethylene jacket, high compression extruded onto the exterior and into the intersticial area of the length of wire rope. The jacket must be of sufficient thickness to prevent bubbling of a subsequent polyurethane jacket by contact of that polyurethane jacket with the lubricant in and on the rope, to compress and permanently seal the lubricant on and within the wire rope; to stiffen the wire rope; and to form a mechanical interlock between the polyethylene jacket and the wire rope thereby containing the strands of the rope as well as holding the low melt temperature plastic jacket onto the rope.

It is still a further object of this invention to extrude a polyurethane jacket onto the low melt temperature jacket in order to reduce splaying, unraveling or flaring of the bristle, to stiffen the wire rope and low melt temperature jacket and to protect the same from abrasion and cutting.

Still further objects of this invention will become apparent in the following specification and descriptions.

BRIEF DESCRIPTIONS OF THE DRAWINGS

DESCRIPTION OF THE PREFERRED EMBODIMENTS

Figure 1:
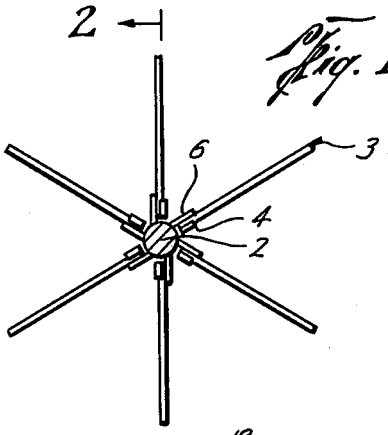
FIG. 1 is a side elevational view of a plurality of the bristles mounted on a rotatable drum or shaft.
Figure 2:
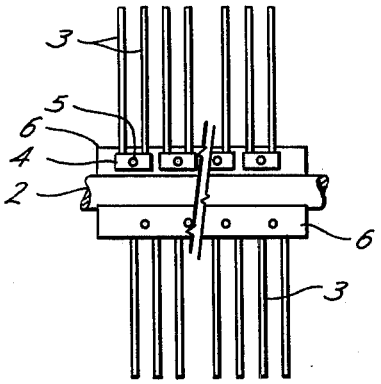
FIG. 2 is a top plan view of the shaft and means for affixing one end of the bristle to the rotatable shaft.

While the embodiments of the flexible bristle illustrated in the drawings and described in detail herein are directed for use primarily in operations involving maintenance of railroad rails, ties and ballast, the bristles are equally suitable for and adaptable to any activity requiring a heavy duty sweeping device by varying the lengths of bristles to be employed as well as the diameters and thicknesses of the components therein.

Figure 3:
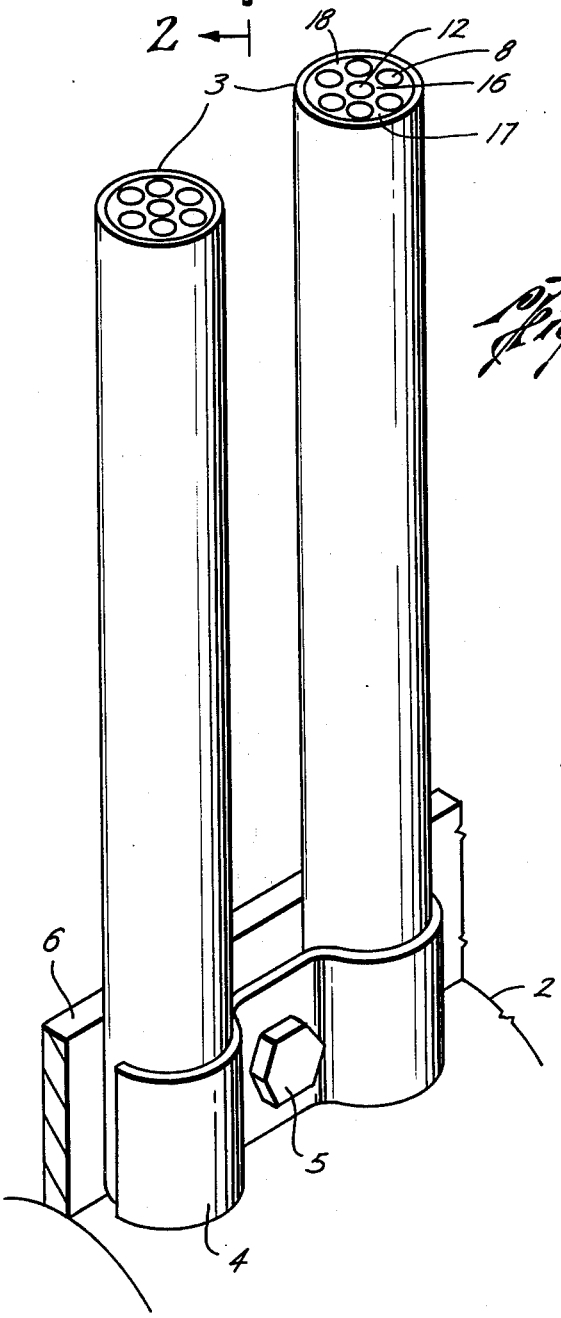
FIG. 3 is an enlarged environmental view of a plurality of affixed bristles, and a typical means for attaching the bristles to the shaft or drum.

Referring now to the drawings, reference to numeral 2 depicts a rotatable shaft or drum having a plurality of flex-limiting plates 6 each rigidly affixed at one edge thereof to the surface of the rotatable shaft or drum. Adjustably affixed to the flex-limiting plate 6 is a means for affixing one end of the bristle to the rotatable shaft and flex-limiting plate. FIG. 3 depicts a typical means thereof comprising an adjustable clamping device having a standard hex head bolt 5 which extends through an aperture within a clamp 4 and into a threaded aperture in the flex-limiting plate 6. Although any means for affixing the surface 3 of the bristle to the flex-limiting plate 6 is satisfactory, the adjustment of the regular hex head bolt 5 provides sufficient containment by the clamp 4 of the bristle surface 3 by driving the clamp 4 toward the surface of the flex-limiting plate 6. Any similar clamp, including one spike passing through the interior of the bristle, will suffice.

Figure 4:
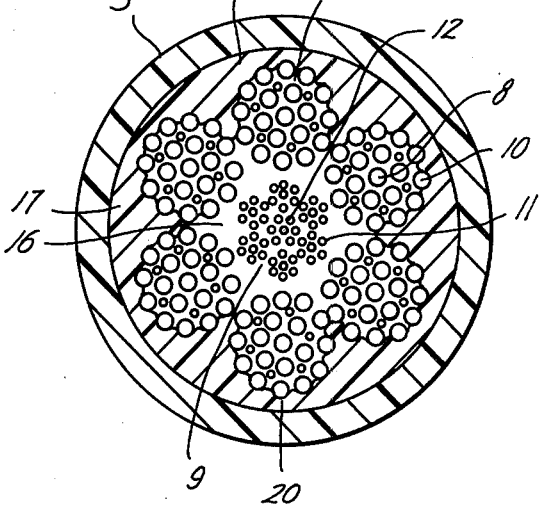
FIG. 4 is an enlarged cross sectional view of the bristle according to the invention.

The inner most component of the bristle comprises but is not limited to a wire rope having a core 12 with surrounding strands 8. A strand 8 is composed of a plurality of wires 10. The wire core is similarly composed of a plurality of wires 11. As illustrated in FIG. 4, the areas situated between the surfaces of the plurality of wires 11 comprise the interstices 9 within the core. Similarly, the areas located between the surfaces of the plurality of wires 10 comprise the interstices 14 within the strand 8. Furthermore, interstices 16 are those areas situated between the surface of the core 12 and the plurality of strands 8. In a like manner, there are interstices 17 defined as the area situated between and in close proximity to the outer surfaces of the plurality of strands 8.

Located within all the above interstices is a lubricant. The purpose of the lubricant is to reduce galling of and friction by the plurality of wires 10 and wires 11 resulting from the relative motion among the wires 10, wires 11, core 12, and strands 8 which occurs as the bristle is flexed. The reduced friction also promotes a lower temperature within the bristle, thereby maintaining the viscosity characteristics of the lubricant. Moreover, reducing the friction and resulting temperature reduces fatigue within wires 10 and 11 of strands 8 and core 12 respectively, thus reducing fracture thereof.

A low density polyethylene jacket 18 is high compression extruded onto the exterior of the wire rope generally defined by the exterior surfaces of strands 8, as well as into the interstices 17. As the polyethylene jacket is high compression extruded onto the wire rope, it tends to drive any uncompacted lubricant toward the core 12, insuring that the lubricant is well contained within the interstices 9, 14, 16 and 17 depending upon the amount of lubricant on and within the wire rope initially. The presence of the polyethylene jacket also increases the longitudinal rigidity of the wire rope. The minimum wall thickness 20 of the polyethylene jacket 18 must be of sufficient thickness to avoid proximity of the lubricant to the polyurethane jacket 3. Direct extrusion of the polyurethane jacket 3 onto the strands 8 would cause the volatile elements of the lubricants to form bubbles which would penetrate and weaken the polyurethane jacket 3.

The wires 10 should not be helically aligned with strands 8 such as occurs in a Lang lay rope, because the forces created by revolving the drum or shaft would cause the wire rope to unscrew from the polyethylene jacket and to separate therefrom. When the wires 10 are angularly displaced from the helical axis of strand 8, and are preferably arranged in a regular lay configuration wherein the wires 10 on the exterior of strands 8 are parallel to the longitudinal axis of the bristle, the polyethylene jacket 18 forms a mechanical interlock with strands 8 which inhibits the wire rope from slipping within the polyethylene jacket 18. Furthermore, this mechanical interlock contains wires 10 of strands 8, thereby inhibiting the fraying, splaying and unraveling of wires 10.

The minimum wall thickness 20 of the polyethylene jacket 18 should preferably be about 0.005 inches in order to prevent bubbling of the polyurethane jacket 3 by the volatile elements of the lubricant. Greater wall thickness 20 may be utilized, but is limited because of the low compressive strength of the polyethylene jacket 18. A greater thickness would cause the bristle to become more difficult to secure to the shaft by clamping means 4, 5, as depicted in FIG. 3.

The polyurethane jacket 3 is extruded onto the polyethylene jacket 18. Polyurethane has good characteristics which protect against abrasion, cutting and tearing. Consequently, the polyurethane jacket 3 protects the polyethylene jacket 18 from normal abrasion, cutting and slicing which occur during sweeping operations. The minimum wall thickness of the polyurethane jacket 3 is not rigidly defined, but thicknesses of less than 0.050 inches are unsatisfactory for use over extended periods of time. There is no rigidly defined maximum wall thickness of the polyurethane jacket 3.

The maximum wall thickness of the polyurethane jacket 3 is to a large degree determined by the overall diameter of the bristle which clamping means 4, 5, for example, can accept. Furthermore, polyurethane creeps, and excessive wall thickness of the polyurethane jacket 3 increases the difficulty in holding the bristle in the clamps on the rotatable shaft or drum 2.

The polyurethane jacket 3 also increases the longitudinal stiffness of the wire rope comprising strands 8 and core 12, and the polyethylene jacket 18. According to the present invention, it is not necessary to bond the polyurethane jacket 3 to the polyethylene jacket 18. Normal extrusion processes of the polyurethane jacket 3 onto the polyethylene jacket 18 provides sufficient containment of the latter and sufficient stiffness of the bristle as a whole.

Some sizes of wire rope are more suitable for certain sweeping operations than others. For instance, a $\frac{3}{4}$ inch diameter wire rope is suitable for use on ballast regulators, while a $\frac{7}{8}$ inch diameter rope is more suitable for use on cribbers and track sweepers. Other diameter wire ropes more suitable for other sweeping operations may be employed. Moreover, the outside diameter of the bristle as exemplified by a surface of the polyurethane jacket 3 may be varied according to the desired stiffness as well as the type of clamping means employed.

Wire rope with Lang lay should be avoided but any other configuration of wire rope maybe utilized so long as it provides the necessary flexibility, stiffness and mechanical interlock such as, but not limited to, one found in a regular lay configuration.

According to the present invention, a preferred embodiment comprises a lubricated wire rope consisting of a 6 × 25 filler wire-preformed, right or left-hand regular lay-improved plow steel, having an independent wire rope core 12, a polyethylene jacket 18 high compression extruded onto the strands 8 of the wire rope and a polyurethane jacket 3 extruded onto the exterior of the polyethylene jacket 18. Wire rope diameters of $\frac{3}{4}$ inch for ballast regulators and $\frac{7}{8}$ inch for cribbers and track sweepers are more suitable. According to the above-mentioned preferred embodiment, the durable bristle provides sufficient stiffness to perform its sweeping function, sufficient flexibility to reduce fracture, sufficient internal lubrication of the core 12 and strands 8, and wires 11 and 10, respectively, to allow the strands 8, core 12, wires 10 and 11 to slip relative to each other when the bristle is flexed and to inhibit entrance of and migration of dust, grit and other foreign matter within and along the interstices 9, 14, 16 and 17. The polyethylene jacket 18 is mechanically interlocked to the strands 8 of the wire rope thereby containing and sealing the lubricant of the rope and preventing the wire rope from slipping within the polyethylene jacket 18. The polyurethane jacket 3 is extruded onto the polyethylene jacket 18 in order to increase the stiffness of the bristle as a whole and to reduce abrasion, cutting and tearing of the polyethylene jacket 18.

While the presently-preferred embodiments of the invention have been given for the purposes of disclosure, changes may be made therein which are within the spirit of the invention as defined by the scope of the appended claims.

What is claimed is:

1. A flexible bristle for use in sweeping comprising:

a length of multistrand wire rope;

a lubricant within the interstices of the wire comprising the strands and core of the rope and within the interstices of the various strands of the rope;

a low melt temperature plastic jacket, high compression extruded onto the exterior and into the interstitial area throughout the length of wire rope; and a polyurethane jacket extruded onto the exterior of the low melt temperature plastic jacket.

2. The apparatus in claim 1 wherein the low melt temperature plastic jacket is a high compression, low density polyethylene jacket having a minimum thickness of about 0.005 inches.

3. The apparatus in claim 1 wherein the polyurethane jacket has a minimum thickness of about 0.050 inches.

4. The apparatus in claim 1 wherein the minimum thickness of the multistrand wire rope is about $\frac{3}{4}$ inch.

5. The apparatus in claim 1 wherein the wire rope is of a type consisting of $\frac{3}{4}$ inch through $\frac{7}{8}$ inch, 6 × 25 filler wire-preformed, right or left-hand regular lay-improved ploy steel, having an independent wire rope core.

6. A flexible bristle for use in a sweeper for maintaining railroad rails, ties and ballast a length of multistrand wire rope having outer strands helically wound around a core the wire of each strand being angularly displaced to the helical axis of said strand of the rope thereby maximizing surface friction on the surface of the strands along the helical axis;

a lubricant within the interstices of the wire of the strands and the strands of the rope;

a low melt temperature plastic jacket, high compression extruded onto the exterior and into the interstitial area of the length of the wire rope; and a polyurethane jacket extruded onto the exterior of the melt temperature plastic jacket.

7. The apparatus in claim 6 wherein the low melt temperature plastic jacket is a low density, high compression extruded polyethylene jacket of sufficient wall thickness to prevent bubbling of the polyurethane jacket.

8. The apparatus in claim 6 wherein the low melt temperature plastic jacket is of sufficient radial thickness to effect a mechanical interlock between the wire rope and the low melt temperature plastic jacket thereby securing the strands of the rope together and securing the low melt temperature plastic jacket to the rope.

9. The apparatus in claim 6 wherein the low melt temperature plastic jacket has a minimum wall thickness of 0.005 inches, thereby confining and permanently sealing the lubricant within the wire rope, increasing the longitudinal stiffness of the rope, and preventing dust, grit and other similar particles from entering into and migrating within the interstices of the rope.

10. The apparatus in claim 6 wherein the polyurethane jacket has a minimum wall thickness of 0.050 inches, thereby stiffening the wire rope and low melt temperature plastic jacket, protecting the same from abrasion, cutting and tearing and minimizing splaying, unraveling or flaring of the bristle.

11. The apparatus in claim 6 wherein the lubricant is of medium to heavy viscosity so as to allow the strands to slip relative to each other without wear as the bristle is flexed, and to prevent dust, grit and other similar particles from entering into and migrating within the interstices of the rope.

12. The apparatus in claim 6 wherein both ends of the wire rope are unwelded thereby allowing the core, strands and wires to slip among themselves with reduced fatigue breaking when the bristle is flexed.

13. A flexible bristle in combination with a sweeping device comprising:

a length of multistrand wire rope having strands and a core;

a lubricant within the interstices of the strands and core of the rope and within the interstices of the various strands of the rope;

a low melt temperature plastic jacket, high compression extruded onto the exterior and into the interstitial area throughout the length of wire rope;

a polyurethane jacket extruded onto the exterior of the low melt temperature plastic jacket; and means for connecting the flexible bristle to the sweeping device thereby providing a sweeper having one or more of said flexible bristles, the combination providing a structure suitable for use in maintaining railroad rails, ties, ballasts and way.

* * * * *